US006607351B1

(12) United States Patent
Hablanian

(10) Patent No.: US 6,607,351 B1
(45) Date of Patent: Aug. 19, 2003

(54) VACUUM PUMPS WITH IMPROVED IMPELLER CONFIGURATIONS

(75) Inventor: Marsbed Hablanian, Wellesley, MA (US)

(73) Assignee: Varian, Inc., Palo Alto, CA (US)

( * ) Notice: Subject to any disclaimer, the term of this patent is extended or adjusted under 35 U.S.C. 154(b) by 0 days.

(21) Appl. No.: 10/099,380

(22) Filed: Mar. 12, 2002

(51) Int. Cl.[7] ..... F04D 19/04
(52) U.S. Cl. ..... 415/90; 415/55.6; 415/143
(58) Field of Search ..... 415/90, 143, 55.1–55.7; 417/423.4

(56) References Cited

U.S. PATENT DOCUMENTS

| | | | | |
|---|---|---|---|---|
| 4,645,413 A | * | 2/1987 | Reich | 415/72 |
| 5,238,362 A | | 8/1993 | Casaro et al. | |
| 5,354,172 A | * | 10/1994 | Schofield | 415/90 |
| 5,358,373 A | | 10/1994 | Hablanian | |
| 5,449,270 A | * | 9/1995 | Levi et al. | 415/90 |
| 5,456,575 A | * | 10/1995 | Helmer et al. | 415/55.1 |
| 5,848,873 A | | 12/1998 | Schofield | |
| 6,135,709 A | | 10/2000 | Stones | |

FOREIGN PATENT DOCUMENTS

DE 39 19 529 A1 1/1990

OTHER PUBLICATIONS

Book by Hablanian, Mars, entitled "High–Vacuum Technology, A Practical Guide", published by Marcel Dekker, Inc., New York, 1997, Chapter 7, pp. 271–277.

* cited by examiner

*Primary Examiner*—Christopher Verdier
(74) *Attorney, Agent, or Firm*—Bella Fishman

(57) ABSTRACT

A vacuum pump includes a housing having an inlet port and an exhaust port, a plurality of vacuum pumping stages located within the housing and disposed between the inlet port and the exhaust port, and a motor. The vacuum pumping stages include gas drag stages, each including a stator and an impeller. The impellers of successive ones of the gas drag stages are configured for efficient operation at progressively higher pressures. The impellers of the gas drag stages may have pumping surfaces with a surface topography for efficient operation at progressively higher pressures. The motor rotates the impellers such that gas is pumped from the inlet port to the exhaust port.

18 Claims, 7 Drawing Sheets

VACUUM PUMPS WITH IMPROVED IMPELLER CONFIGURATIONS

FIELD OF THE INVENTION

This invention relates to turbomolecular vacuum pumps and hybrid vacuum pumps and, more particularly, to vacuum pumps having impeller configurations which assist in achieving one or more of compact pump structures, increased discharge pressure and decreased operating power in comparison with prior art vacuum pumps.

BACKGROUND OF THE INVENTION

Conventional turbomolecular vacuum pumps include a housing having an inlet port, an interior chamber containing a plurality of axial pumping stages and an exhaust port. The exhaust port is typically attached to a roughing vacuum pump. Each axial pumping stage includes a stator having inclined blades and a rotor having inclined blades. The rotor and stator blades are inclined in opposite directions. The rotor blades are rotated at high rotational speed by a motor to pump gas between the inlet port and the exhaust port. A typical turbomolecular vacuum pump may include nine to twelve axial pumping stages.

Variations of the conventional turbomolecular vacuum pump often referred to as hybrid vacuum pumps, have been disclosed in the prior art. In one prior art configuration, one or more of the axial pumping stages are replaced with molecular drag stages, which form a molecular drag compressor. This configuration is disclosed in Varian, Inc. U.S. Pat. No. 5,238,362, issued Aug. 24, 1993. Varian, Inc sells hybrid vacuum pumps including an axial turbomolecular compressor and a molecular drag compressor in a common housing. Molecular drag stages and regenerative stages for hybrid vacuum pumps are disclosed in Varian, Inc. U.S. Pat. No. 5,358,373, issued Oct. 25, 1994. A gradual change in the design of the stators of the axial pumping stages is also disclosed in U.S. Pat. No. 5,358,373. Other hybrid vacuum pumps are disclosed in German Patent No. 3,919,529, published Jan. 18, 1990; U.S. Pat. No. 5,848,873, issued Dec. 15, 1998; and U.S. Pat. No. 6,135,709, issued Oct. 24, 2000. The disclosed hybrid vacuum pumps use existing impeller types and switch abruptly from one impeller type to another.

Molecular drag stages include a rotating disk, or impeller, and a stator. The stator defines a tangential flow channel and an inlet and an outlet for the tangential flow channel. A stationary baffle, often called a stripper, disposed in the tangential flow channel separates the inlet and the outlet. As is known in the art, the momentum of the rotating disk is transferred to gas molecules within the tangential flow channel, thereby directing the molecules toward the outlet. Molecular drag stages were developed for molecular flow conditions.

Another type of molecular drag stage includes a cylindrical drum that rotates within a housing having a cylindrical interior wall in close proximity to the rotating drum. The outer surface of the cylindrical drum or the wall is provided with a helical groove. As the drum rotates, gas is pumped through the groove by molecular drag.

A regenerative vacuum pumping stage includes a regenerative impeller, which operates within a stator that defines a tangential flow channel. The regenerative impeller includes a rotating disk having spaced-apart radial ribs at or near its outer periphery. Regenerative vacuum pumping stages were developed for viscous flow conditions.

In molecular flow, pumping action can be produced by a fast moving flat surface dragging molecules in the direction of movement. Depending on design, very high-pressure ratios per stage can be achieved by a single disk impeller having a flat surface.

When viscous flow is approached, the simple momentum transfer does not work as well, because of increased backward flow due to the establishment of a pressure gradient rather than a molecular density gradient. At the high end of the pressure spectrum, there is a well-known art of regenerative stages or blowers, which, near atmospheric pressure, produce pressure ratios more than two per stage at high peripheral velocities.

However, the impellers for molecular drag stages and the impellers for regenerative blowers do not work efficiently throughout the pressure range involved in high vacuum pumps. Flat surface impellers work reasonably well at pressures up to about one torr in medium sized pumps. Above that pressure level, flat surface impellers become inefficient and begin to require excessive power and produce unwanted heat, as well as exhibiting a reduction in the achievable compression ratio. Attempts to extend the flat surface design to atmospheric pressure have not been successful because of the need for very small gaps between moving and stationary surfaces. Regenerative blowers work best above about 20 torr, producing satisfactory pressure ratios. Usually a particular design produces a narrow range of efficient operation. Therefore, the design of impellers is important with respect to power saving in order to reduce heating of the rotor.

Hybrid vacuum pumps, which utilize molecular drag stages typically, have rotor-stator gaps of about eight thousandths of an inch. Reducing the gap to smaller than this dimension requires extremely tight tolerances and increases cost. This gap dimension necessitates a relatively large number of stages to achieve the desired overall compression ratio. However, [these] this approach results in increased cost and size, and may require an unacceptably long rotor shaft.

Accordingly, there is a need for vacuum pumps having impeller configurations, which overcome one or more of the above disadvantages.

SUMMARY OF THE INVENTION

According to a first aspect of the invention, a vacuum pump is provided. The vacuum pump comprises a housing having an inlet port and an exhaust port, a plurality of vacuum pumping stages located within the housing and disposed between the inlet port and the exhaust port, and a motor. The vacuum pumping stages comprise molecular and transition flow drag stages, each including a stator and an impeller. The impellers of successive ones of the gas drag stages are configured for efficient operation at progressively higher pressures. The motor rotates the impellers such that gas is pumped from the inlet port to the exhaust port.

The gas drag stages may include a first stage wherein the impeller comprises a disk having a smooth pumping surface and a second stage wherein the impeller comprises a disk having a roughened pumping surface. The gas drag stages may further include a third stage wherein the impeller comprises a disk having a grooved pumping surface. The vacuum pumping stages may further comprise one or more regenerative stages.

The impellers of successive ones of the molecular drag stages may have pumping surfaces with a surface topography for efficient operation at progressively higher pressures.

The pumping surface of the impeller may be an annular region at or near the outer periphery of the disk. The pumping surface may include all or part of the front surface, all or part of the rear surface and/or all or part of the edge surface of the impeller.

BRIEF DESCRIPTION OF THE DRAWINGS

For a better understanding of the present invention, reference is made to the accompanying drawings, which are incorporated herein by reference and in which.

DETAILED DESCRIPTION OF THE INVENTION

Figure 1:
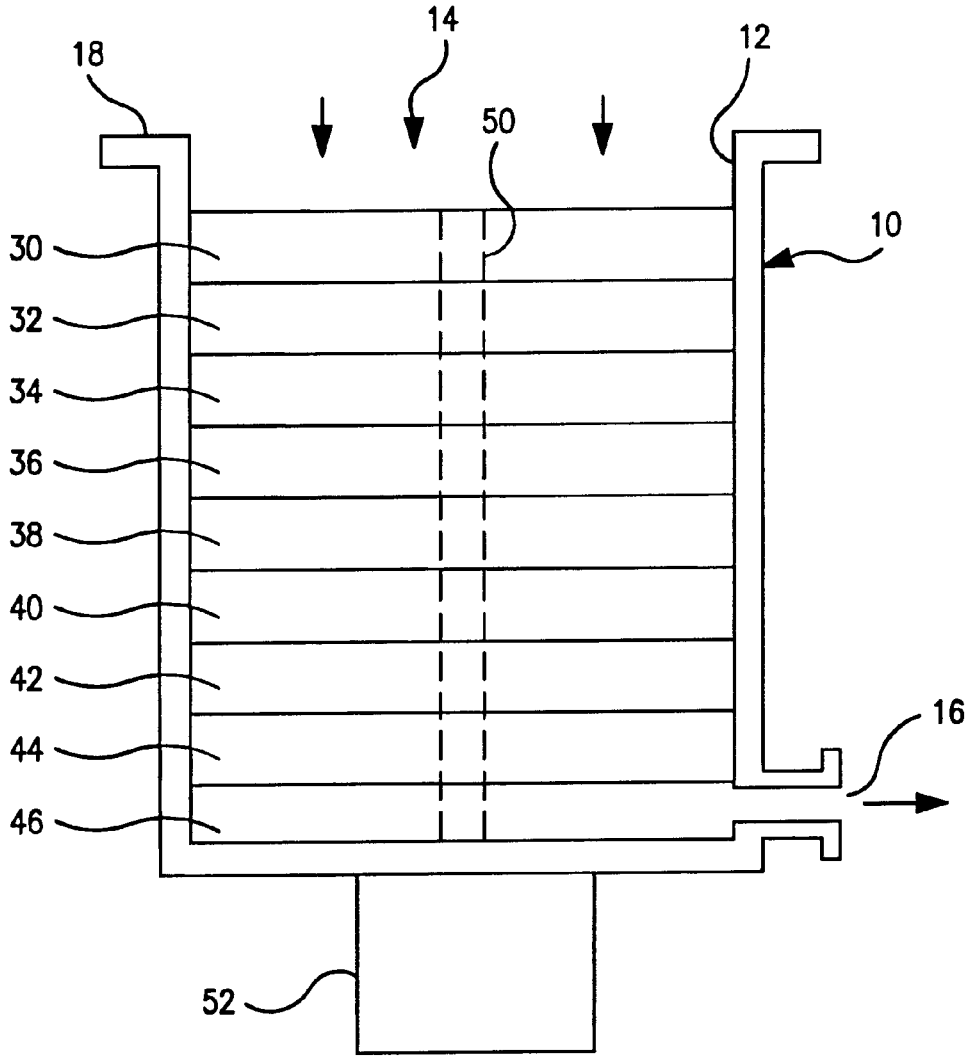
FIG. 1 is a simplified cross-sectional schematic diagram of a vacuum pump in accordance with an embodiment of the invention.

A simplified cross-sectional diagram of a high vacuum pump in accordance with an embodiment of the invention is shown in FIG. 1. A housing 10 defines an interior chamber 12 having an inlet port 14 and an exhaust port 16. The housing 10 includes a vacuum flange 18 for sealing the inlet port 14 to a vacuum chamber (not shown) to be evacuated. The exhaust port 16 may be connected to a roughing vacuum pump (not shown). In cases where the vacuum pump is capable of exhausting to atmospheric pressure, the roughing pump is not required.

Located within housing 10 are vacuum pumping stages 30, 32, . . . , 46. Each vacuum pumping stage includes a stationary member, or stator, and a rotating member, also known as an impeller or a rotor. The rotating member of each vacuum pumping stage is coupled by a drive shaft 50 to a motor 52. The shaft 50 is rotated at high speed by motor 52, causing rotation of the rotating members about a central axis and pumping of gas from inlet port 14 to exhaust port 16. The embodiment of FIG. 1 has nine stages. It will be understood that a different number of stages can be utilized, depending on the vacuum pumping requirements.

Figure 2:
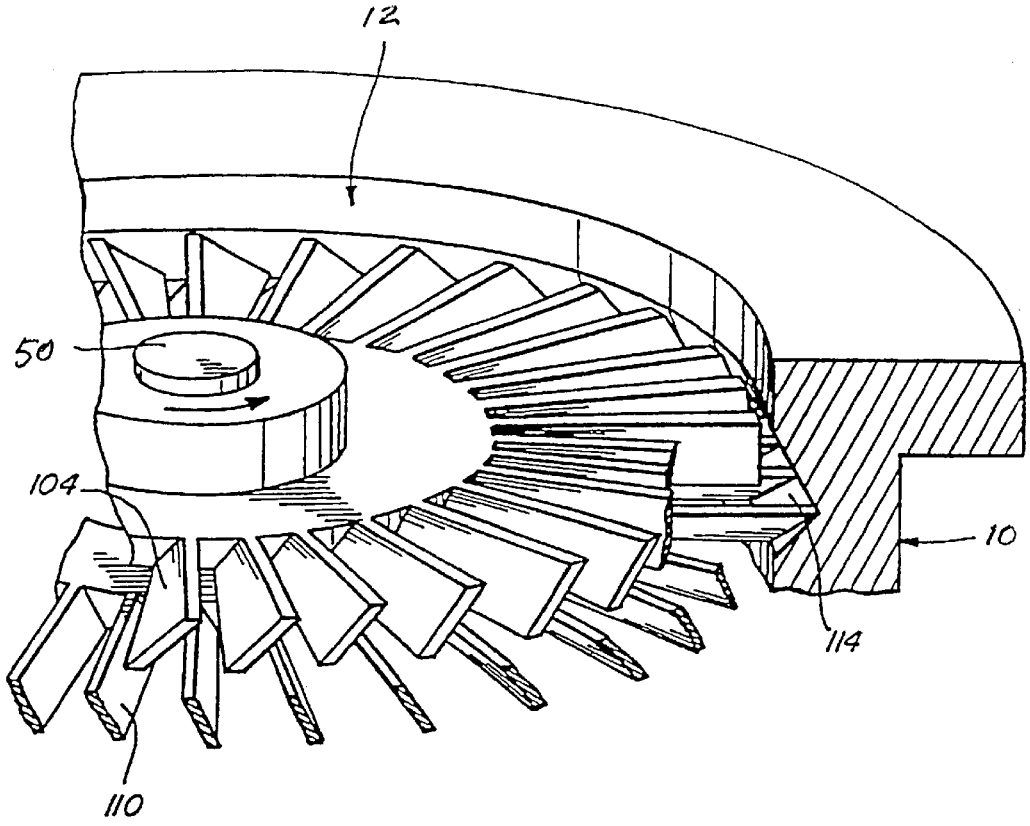
FIG. 2 PRIOR ART
FIG. 2 is a fragmentary perspective view of an axial flow stage that may be utilized in the vacuum pump of FIG. 1.

According to an aspect of the invention, the vacuum pumping stages 30, 32, . . . , 46 are configured for efficient operation within a specified pressure range. By way of example, the pressure at inlet port 14 during operation may be on the order of $10^{-5}$ to $10^{-6}$ torr, whereas the pressure at exhaust port 16 may be at or near atmospheric pressure. The pressure through the vacuum pump gradually increases from inlet port 14 to exhaust port 16. The characteristics of each vacuum pumping stage may be selected for efficient operation over an expected operating pressure range of that stage. By way of example, vacuum pumping stages 30, 32 and 34 may be axial flow stages, as shown in FIG. 2 and described below. Vacuum pumping stages 36, 38, 40 and 42 may be molecular drag stages, as described below in connection with FIGS. 3–5 and 9A–12B. Molecular drag stages 36, 38, 40 and 42 may have impellers, which are configured for operation at successively higher pressures, as described below. Vacuum pumping stages 44 and 46 may be regenerative vacuum pumping stages, as described below in connection with FIGS. 6–8, 13A and 13B.

An embodiment of an axial flow stage is shown in FIG. 2. Pump housing 10 has inlet port 12. The axial flow stage includes a rotor 104 and a stator 110. The rotor 104 is connected to shaft 50 for high speed rotation about the central axis. The stator 110 is mounted in a fixed position relative to housing 10. The rotor 104 and the stator 110 each have multiple inclined blades. The blades of rotor 104 are inclined in an opposite direction from the blades of stator 110. Variations of conventional axial flow stages are disclosed in the aforementioned U.S. Pat. No. 5,358,373, which is hereby incorporated by reference.

Figure 3:
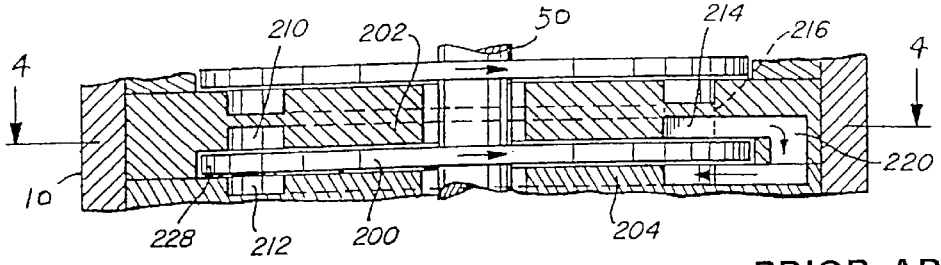
FIG. 3 PRIOR ART
FIG. 3 is a partial cross-sectional view of a vacuum pump utilizing molecular drag vacuum pumping stages.
Figure 4:
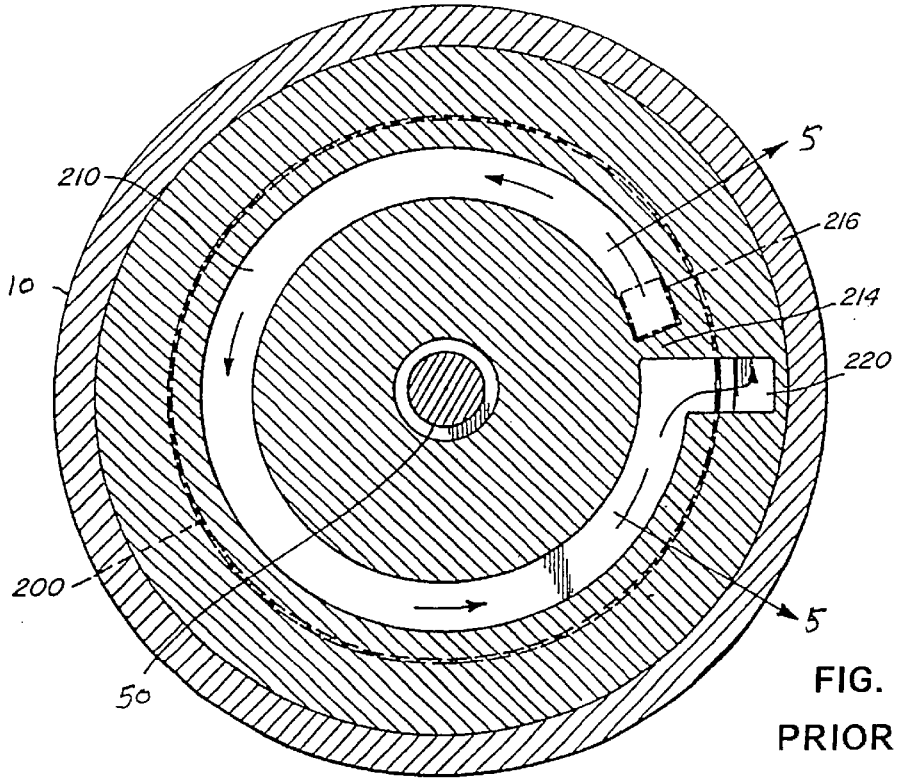
FIG. 4 PRIOR ART
FIG. 4 is a plan view of the molecular drag stage, taken along the line 4—4 of FIG. 3.
Figure 5:
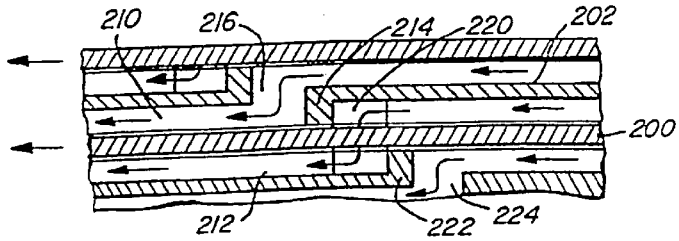
FIG. 5 PRIOR ART
FIG. 5 is a partial cross-sectional view of the molecular drag stage, taken along the line 5—5 of FIG. 4.

An example of a molecular drag vacuum pumping stage is illustrated in FIGS. 3–5. In the molecular drag stage, the rotor, or impeller, comprises a disk and the stator is provided with channels in closely spaced opposed relationship to the disk. When the disk is rotated at high speed, gas is caused to flow through the stator channels by molecular drag produced by the rotating disk. As described below, the impeller may have different configurations for efficient operation at different pressures.

Referring to FIGS. 3–5, a molecular drag stage includes a disk 200, an upper stator portion 202 and a lower stator portion 204 mounted within housing 10. The upper stator portion 202 is located in proximity to an upper surface of disk 200, and lower stator portion 204 is located in proximity to a lower surface of disk 200. The upper and lower stator portions 202 and 204 together constitute the stator of the molecular drag stage. The disk 200 is attached to shaft 50 for high speed rotation about the central axis of the vacuum pump.

The upper stator portion 202 is provided with an upper channel 210. The channel 210 is located in opposed relationship to the upper surface of disk 200. The lower stator portion 204 is provided with a lower channel 212, which is located in opposed relationship to the lower surface of disk 200. In the embodiment of FIGS. 3–5, the channels 210 and 212 are circular and are concentric with disk 200. The upper stator portion 202 includes a blockage 214 of channel 210 at one circumferential location. The channel 210 receives gas from the previous stage through a conduit 216 on one side of blockage 214. The gas is pumped through channel 210 by molecular drag produced by rotating disk 200. At the other side of blockage 214, a conduit 220 formed in stator portions 202 and 204 interconnects channels 210 and 212 around the outer peripheral edge of disk 200. The lower stator portion 204 includes a blockage 222 of lower channel 212 at one circumferential location. The lower channel 212 receives gas on one side of blockage 222 through conduit 220 from the upper surface of disk 200 and discharges gas through a conduit 224 on the other side of blockage 222 to the next stage.

In operation, disk 200 is rotated at high speed about shaft 50. Gas is received from the previous stage through conduit 216. The previous stage can be a molecular drag stage, an axial flow stage, or any other suitable vacuum pumping stage. The gas is pumped around the circumference of upper channel 210 by molecular drag produced by rotation of disk 200. The gas then passes through conduit 220 around the outer periphery of disk 200 to lower channel 212. The gas is then pumped around the circumference of lower channel 212 by molecular drag and is exhausted through conduit 224 to the next stage or to the exhaust port of the pump. Thus, upper channel 210 and lower channel 212 are connected such that gas flows through them in series. In other embodiments, the upper and lower channels may be connected in parallel. Two or more concentric pumping channels can be used, connected in series. Additional embodiments of molecular drag stages are disclosed in the aforementioned U.S. Pat. No. 5,358,373.

Figure 6:
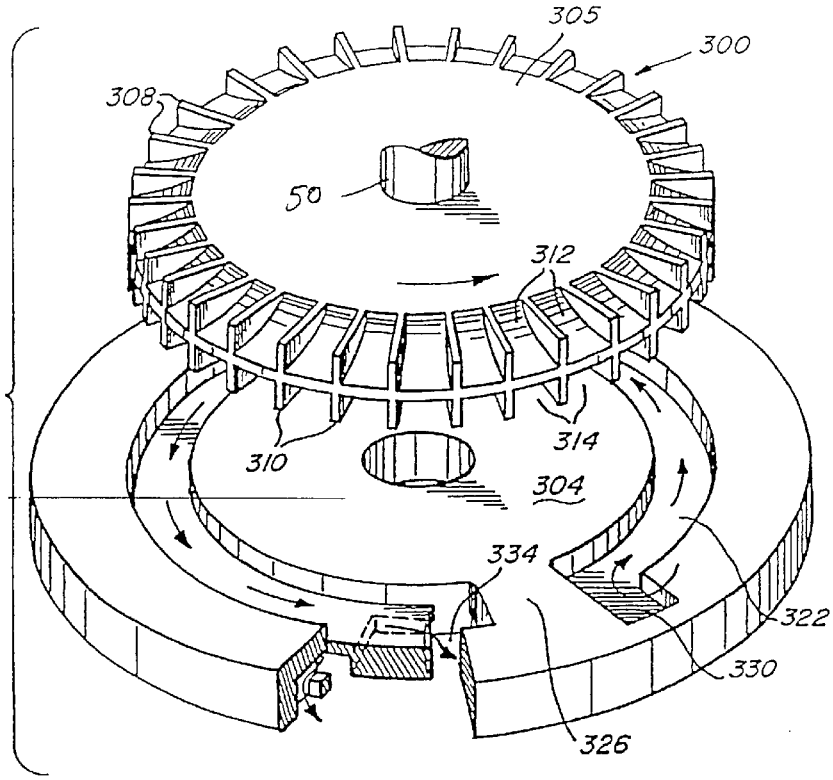
FIG. 6 PRIOR ART
FIG. 6 is an exploded perspective view of a regenerative vacuum pumping stage, showing a regenerative impeller and a lower stator portion.
Figure 7:
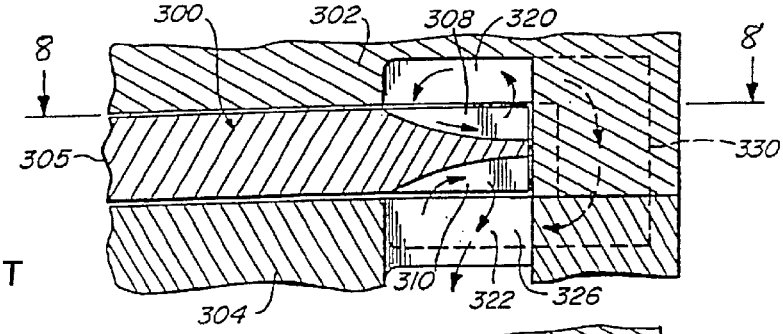
FIG. 7 PRIOR ART
FIG. 7 is a partial cross-sectional view of the regenerative vacuum pumping stage of FIG. 6.
Figure 8:
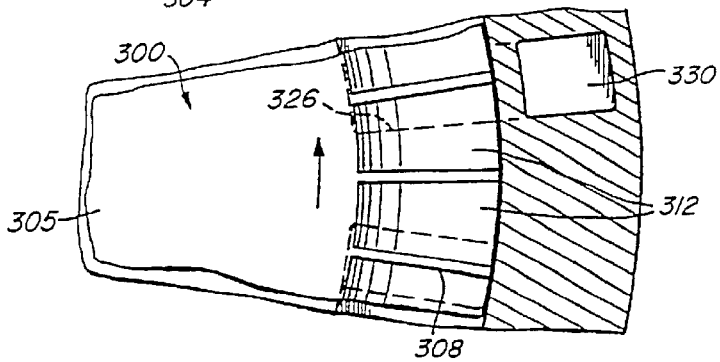
FIG. 8 PRIOR ART
FIG. 8 is a partial plan view of the regenerative vacuum pumping stage, taken along the line 8—8 of FIG. 7.

An example of a regenerative vacuum pumping stage is shown in FIGS. 6–8. The regenerative vacuum pumping stage includes a regenerative impeller 300 which operates with a stator having an upper stator portion 302 adjacent to an upper surface of regenerative impeller 300, and a lower stator portion 304 adjacent to the lower surface of regenerative impeller 300. The upper stator portion 302 is omitted from FIG. 6 for clarity. The regenerative impeller 300 comprises a disk 305 having spaced-apart radial ribs 308 on its upper surface and spaced-apart radial ribs 310 on its lower surface. The ribs 308 and 310 are preferably located at or near the outer periphery of disk 305. Cavities 312 are defined between each pair of ribs 308, and cavities 314 are defined between each pair of ribs 310. In the embodiment of FIGS. 6–8, the cavities 312 and 314 have curved contours formed by removing material of the disk 305 between ribs 308 and between ribs 310. The cross-sectional shape of the cavities 312 and 314 can be rectangular, triangular, or any other suitable shape. The disk 305 is attached to shaft 50 for high speed rotation around the central axis of the vacuum pump.

The upper stator portion 302 has a circular upper channel 320 formed in opposed relationship to ribs 308 and cavities 312. The lower stator portion 304 has a circular lower channel 322 formed in opposed relationship to ribs 310 and cavities 314. The upper stator portion 302 further includes a blockage (not shown) of channel 320 at one circumferential location. The lower stator portion 304 includes a blockage 326 of channel 322 at one circumferential location. The stator portions 302 and 304 define a conduit 330 adjacent to blockage 326 that interconnects upper channel 320 and lower channel 322 around the edge of disk 305. Upper channel 320 receives gas from a previous stage through a conduit (not shown). The lower channel 322 discharges gas to a next stage through a conduit 334.

In operation, disk 305 is rotated at high speed about shaft 50. Gas entering upper channel 320 from the previous stage is pumped through upper channel 320. The rotation of disk 305 and ribs 308 causes the gas to be pumped along a roughly helical path through cavities 312 and upper channel 320. The gas then passes through conduit 330 into lower channel 322 and is pumped through channel 322 by the rotation of disk 305 and ribs 310. In the same manner, the ribs 310 cause the gas to be pumped in a roughly helical path through cavities 314 and lower channel 322. The gas is then discharged to the next stage through conduit 334.

It will be understood that the size, shape and spacing of ribs 308 and 310, and the size and shape of the corresponding cavities 312 and 314 can be varied. Furthermore, channels 320 and 322 may be connected in series or in parallel. Different configurations of regenerative vacuum pumping stages are disclosed in the aforementioned U.S. Pat. No. 5,358,373.

The molecular drag stages in the vacuum pump of FIG. 1 may have different impeller configurations, which are optimized for operation at different pressure levels. Each impeller is generally disk-shaped and has at least one pumping surface at or near its outer periphery. Typically, the pumping surface is an annular region on the front surface, the rear surface, or both, of the disk-shaped impeller. In addition, the pumping surface may include the outer edge that joins the front and rear surfaces.

Figure 9A:
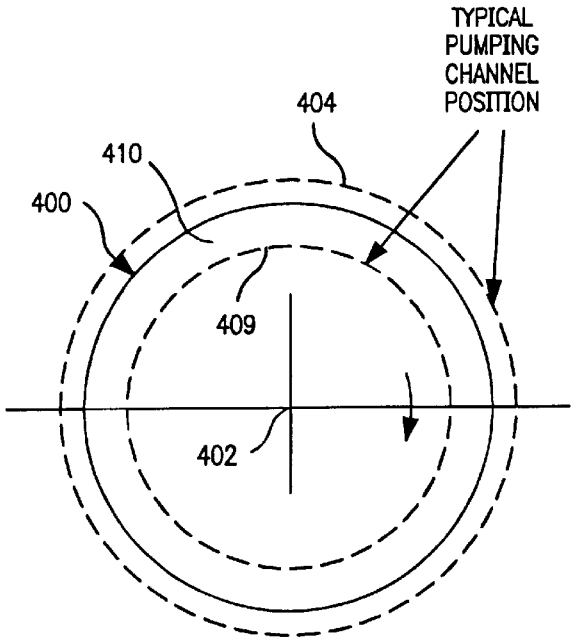
FIG. 9A PRIOR ART
FIGS. 9A and 9B are plan and side views, respectively, of a molecular drag impeller having a smooth pumping surface.
Figure 9B:
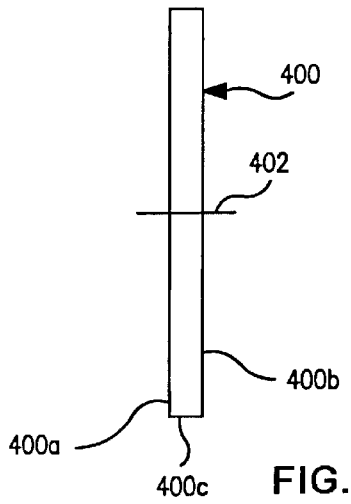
FIG. 9B PRIOR ART

Referring to FIGS. 9A and 9B, a disk-shaped impeller 400 for a molecular drag stage is shown. Impeller 400 rotates at high speed about an axis 402 during operation. A stator having a pumping channel 404, indicated by dashed lines in FIG. 9A, is positioned in close proximity to impeller 400. Pumping channel 404 is typically located at or near an outer periphery of impeller 400. A portion of impeller 400 facing pumping channel 404 functions as a vacuum pumping surface 410. Thus, vacuum pumping surface 410 is the portion of impeller 400 that is exposed to pumping channel 404. The vacuum pumping surface 410 is typically an annular area of impeller 400 at or near its outer periphery. Vacuum pumping surface 410 may be located on a front surface 400*a*, a rear surface 400*b*, or both, of impeller 400. In addition, vacuum pumping surface 410 may be located on an edge surface 400*c* of disk-shaped impeller 400. The impeller 400 may include two or more concentric vacuum pumping surfaces on front surface 400*a*, rear surface 400*b*, or both, depending on the stator configuration.

In accordance with an aspect of the invention, the impellers in gas drag stages of the vacuum pump are configured for efficient operation at different pressure levels in order to enhance vacuum pump operation as the pressure increases from the inlet port 14 to the exhaust port 16 of the vacuum pump. In particular, the vacuum pumping surface 410 of impeller 400 is configured for efficient operation over an expected pressure range of that stage in the vacuum pump. The vacuum pumping surfaces of the impellers in the vacuum pump have a surface topography that is selected for efficient vacuum pumping at the expected pressure range of that vacuum pumping stage. Preferably, the vacuum pumping surface is relatively smooth for operation at relatively low pressures and has increased surface roughness for operation at higher pressures. Thus, the vacuum pump may utilize a series of vacuum pumping stages in which the impellers have progressively greater surface roughness for operation at progressively higher pressures.

A set of impellers in accordance with an embodiment of the invention is shown in FIGS. 9A–13B. The impellers may be used in different stages of the vacuum pump of FIG. 1 or in any other multiple stage vacuum pump. The vacuum pumping characteristics of the impellers may be varied individually or as a set within the scope of the invention. In addition the set may include more or fewer impellers.

Referring to FIGS. 9A and 9B, impeller 400 may be utilized in vacuum pumping stage 36 of vacuum pump 10.

The vacuum pumping surface 410 of impeller 400 is relatively flat and smooth, and is designed for operation at relatively low pressures. The flat impeller operates most efficiently at pressures in the molecular flow and the initial transition flow ranges, i.e., pressures lower than about 1 torr in mid-sized pumps.

Figure 10A:
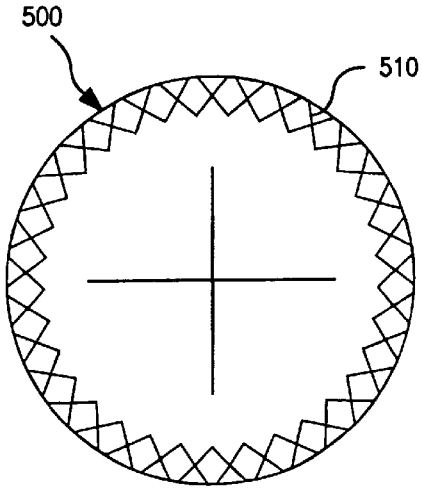
FIGS. 10A and 10B are plan and side views, respectively, of a molecular drag impeller having a roughened pumping surface.
Figure 10B:
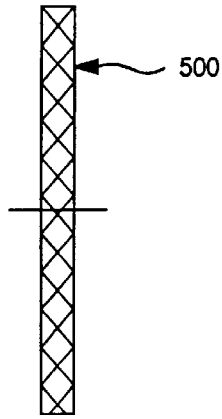

Referring to FIGS. 10A and 10B, an impeller 500 may be utilized in vacuum pumping stage 38 of vacuum pump 10. Impeller 500 is configured for operation at higher pressures than impeller 400 of FIGS. 9A and 9B and has a roughened vacuum pumping surface 510. The surface [roughness] topography depends on the expected operating pressure range and should be sufficient to increase the boundary layer adjacent to the impeller surface, i.e., to induce a thicker section of flow into the drag mechanism.

Figure 11A:
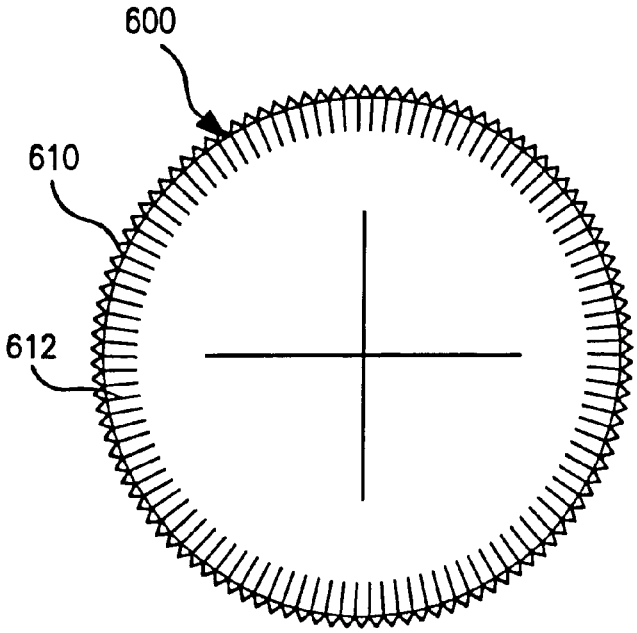
FIGS. 11A and 11B are plan and side views, respectively, of a molecular drag impeller having a pumping surface provided with relatively shallow grooves.
Figure 11B:
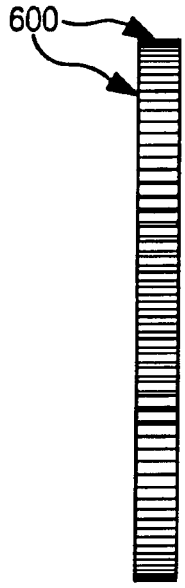

Referring to FIGS. 11A and 11B, an impeller 600 may be utilized in vacuum pumping stage 40 of vacuum pump 10. Vacuum pumping surfaces 610 of impeller 600 are configured for operation at higher pressures than impeller 500 of FIGS. 10A and 10B and may have a series of radial grooves in vacuum pumping [surface] surfaces 610. The spacing and depth of the grooves depend on the expected operating pressure range. Preferably, the grooves 612 may have depths in a range of about 1 to 2 millimeters in mid-sized pumps. In other embodiments for operation in the same pressure range, the vacuum pumping surfaces 610 may have increased surface roughness in comparison with impeller 500 or may have any surface topography that produces efficient operation in the expected pressure range.

Figure 12A:
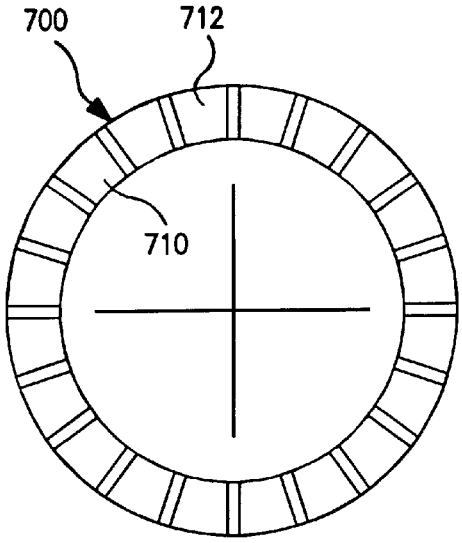
FIGS. 12A and 12B are plan and side views, respectively, of a molecular drag impeller having a pumping surface provided with relatively deep grooves.
Figure 12B:
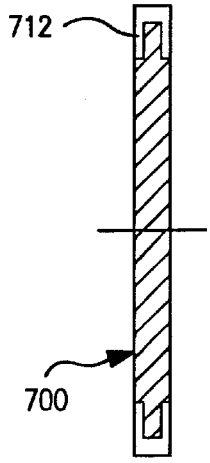

Referring to FIGS. 12A and 12B, an impeller 700 may be utilized in vacuum pumping stage 42 of vacuum pump 10. Impeller 700 has a vacuum pumping surface 710 that is configured for operation at higher pressures than impeller 600 of FIGS. 11A and 11B. Vacuum pumping surface 710 of impeller 700 may have grooves 712 that are deeper and/or more closely spaced than the grooves 612 on impeller 600. Alternatively, vacuum pumping surface 710 may have another surface topography that is selected for efficient operation in the expected operating pressure range.

Figure 13A:
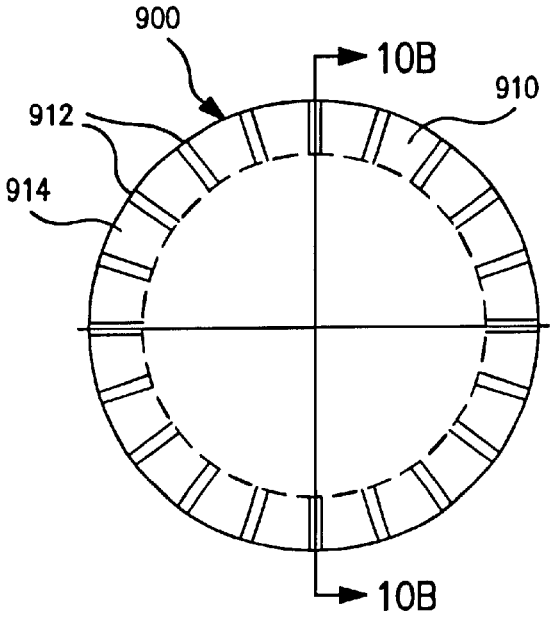
FIGS. 13A and 13B are plan and cross-sectional views, respectively, of an impeller for a regenerative vacuum pumping stage.
Figure 13B:
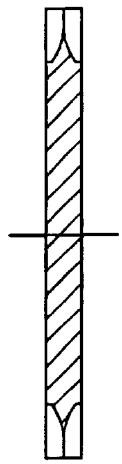

Referring to FIGS. 13A and 13B, a regenerative impeller 900 may be utilized in vacuum pumping stages 44 and 46 of vacuum pump 10. Impeller 900 includes a vacuum pumping surface 910 having a series of spaced-apart radial ribs 912 which define cavities 914. The size and shape of the ribs 912 and the corresponding cavities 914 are selected for efficient vacuum pumping over the expected operating pressure range. For example, the radial extent of ribs 912 may be varied. The regenerative impellers in vacuum pumping stages 44 and 46 may be configured for efficient operation over different pressure ranges. In some embodiments, vacuum pump 10 may include a single regenerative vacuum pumping stage or more than two regenerative vacuum pumping stages having impellers, which are configured for operation at progressively higher pressures. The configurations of the ribs and the cavities may be selected for efficient operation in the expected operating pressure range. In other embodiments, two or more regenerative vacuum pumping stages may utilize the same impeller configuration.

Together, impellers 400, 500, 600, 700 and 900 shown in FIGS. 9A and 9B, 10A and 10B, 11A and 11B, 12A and 12B, and 13A and 13B, respectively, constitute a set of impellers having graduated characteristics for efficient operation at progressively higher pressures. Thus, one or more impellers may have characteristics selected for efficient operation under molecular flow conditions, one or more impellers may have characteristics selected for efficient operation under transition flow conditions and one or more impellers may have characteristics selected for efficient operation under viscous flow conditions, with the impellers in the set having a gradual change in pumping characteristics. Each impeller has a vacuum pumping surface with a surface topography that is configured for efficient operation over an expected pressure range. While the impellers in the set have a gradual change in pumping characteristics, this does preclude two or more impellers being the same. As noted above, the vacuum pumping surface of each impeller may include all or part of the front surface, all or part of the rear surface and/or all or part of the edge surface in any combination.

The principles described herein may be applied to different configurations of molecular drag pumps and regenerative pumps. For example, the invention may be applied to Holweck-type pumps and Siegbahn-type pumps, as described by Marsbed H. Hablanian in "High-Vacuum Technology, a Practical Guide," Marcel Dekker, Inc., 1997, pages 271–277.

It should be understood that various changes and modifications of the embodiments shown in the drawings described in the specification may be made within the spirit and scope of the present invention. Accordingly, it is intended that all matter contained in the above description and shown in the accompanying drawings be interpreted in an illustrative and not in a limiting sense. The invention is limited only as defined in the following claims and the equivalents thereto.

What is claimed is:

1. A vacuum pump comprising:

a housing having an inlet port and an exhaust port;

a plurality of vacuum pumping stages located within said housing and disposed between said inlet port and said exhaust port, said vacuum pumping stages comprising transition and viscous flow gas drag stages disposed in proximity to said exhaust port, each including a stator and an impeller, wherein each successive impeller of respective transition and viscous flow gas drag stages has a pumped gas engaging surface having a predetermined topography of said pumped gas engaging surface greater than the preceding one for efficient operation at progressively increased toward said exhaust port higher pressures; and a motor for rotating said impellers such that gas is pumped from said inlet port to said exhaust port.

2. The vacuum pump as defined in claim 1, wherein said gas drag stages include a first stage wherein the impeller comprises a disk having a smooth pumping surface and a second stage wherein the impeller comprises a disk having a roughened pumping surface.

3. The vacuum pump as defined in claim 2, wherein said gas drag stages further include a third stage wherein the impeller comprises a disk having a grooved pumping surface.

4. The vacuum pump as defined in claim 3, wherein said vacuum pumping stages further comprise one or more regenerative stages.

5. The vacuum pump as defined in claim 1, wherein said vacuum pumping stages further comprise at least two regenerative stages configured for efficient operation at different pressures.

6. The vacuum pump as defined in claim 3, wherein said vacuum pumping stages further comprise at least one axial flow stage having a rotor and a stator, wherein the rotor and the stator have inclined blades.

7. The vacuum pump as defined in claim 1, wherein said gas drag stages include a first stage wherein the impeller comprises a disk having a smooth pumping surface, a second stage wherein the impeller comprises a disk having a roughened pumping surface, a third stage wherein the impeller comprises a disk having a pumping surface with shallow grooves and a fourth stage wherein the impeller comprises a disk having a pumping surface with deeper grooves.

8. The vacuum pump as defined in claim 1, wherein the impellers of successive ones of said gas drag stages have pumping surfaces with successively coarser surface topography.

9. The vacuum pump as defined in claim 1, wherein the impellers of said gas drag stages have pumping surfaces on respective front surfaces thereof.

10. The vacuum pump as defined in claim 9, wherein the impellers of said gas drag stages have pumping surfaces on respective rear surfaces thereof.

11. The vacuum pump as defined in claim 10, wherein the impellers of said gas drag stages have pumping surfaces on respective edge surfaces thereof.

12. The vacuum pump as defined in claim 1, wherein the impellers of said gas drag stages have annular pumping surfaces.

13. A vacuum pump comprising:

a housing having an inlet port and an exhaust port;

a plurality of vacuum pumping stages located within said housing and disposed between said inlet port and said exhaust port, said vacuum pumping stages comprising molecular drag stages and transition and viscous drag stages of different geometric configurations, each including a stator and an impeller having different predetermined topography of a pumping surface, wherein the impellers of successive ones of said transition and viscous drag stages have pumping surfaces with the surface topography for efficient operation at progressively increased toward said exhaust port higher pressures; and a motor for rotating said impellers such that gas is pumped from said inlet port to said exhaust port.

14. The vacuum pump as defined in claim 13, wherein said transition and viscous drag stages include a first stage wherein the impeller comprises a disk having a smooth pumping surface and a second stage wherein the impeller comprises a disk having a roughened pumping surface.

15. The vacuum pump as defined in claim 14, wherein said transition and viscous drag stages further comprise a third stage wherein the impeller comprises a disk having a pumping surface with shallow grooves.

16. The vacuum pump as defined in claim 15, wherein said vacuum pumping stages further comprise at least one regenerative stage.

17. The vacuum pump as defined in claim 15, wherein said vacuum pumping stages further comprise at least one axial flow stage having a rotor and a stator, wherein the rotor and the stator have inclined blades.

18. The vacuum pump as defined in claim 13, wherein the impellers of said transition and viscous drag stages comprise disks having annular pumping surfaces.

* * * * *